United States Patent [19]

Walmer

[11] 4,021,960

[45] May 10, 1977

[54] DOLL HOUSE HAVING LEFT AND RIGHT ROOF MEMBERS

[76] Inventor: Harry E. Walmer, 721 N. Overlook Drive, Alexandria, Va. 22305

[22] Filed: Sept. 23, 1975

[21] Appl. No.: 615,894

[52] U.S. Cl. ..... 46/19
[51] Int. Cl.[2] ..... A63H 33/10
[58] Field of Search ..... 46/19, 20, 21, 12

[56] References Cited

UNITED STATES PATENTS

| | | | |
|---|---|---|---|
| 1,302,785 | 5/1919 | Gilbert | 46/21 |
| 1,316,690 | 9/1919 | Crosby et al. | 46/19 |
| 1,510,326 | 9/1924 | Locke | 46/20 X |
| 1,567,849 | 12/1925 | Kliner | 46/21 |
| 3,020,601 | 2/1962 | Stambaugh et al. | 46/19 |
| 3,906,659 | 9/1975 | Walmer | 46/21 X |

FOREIGN PATENTS OR APPLICATIONS

| | | | |
|---|---|---|---|
| 21,684 | 10/1905 | Austria | 46/19 |
| 613,767 | 12/1948 | United Kingdom | 46/19 |

OTHER PUBLICATIONS

Hall's – "A-Frame House" – a copy of this publication (a single page).

*Primary Examiner*—F. Barry Shay
*Attorney, Agent, or Firm*—M. Ted Raptes

[57] ABSTRACT

The invention relates to a doll house having an A-frame design, e.g., a doll house typifying a hunting or mountain lodge. The doll house is of the collapsible type having a novel design in its construction. It is constructed of a small number of individual panels which comprise the walls, floors, roof, etc. The panels are provided with grooves and slots so that all the panels slide together easily and support one another. No tools or screws are required for construction and the parts are locked tightly together in a rigid structure by the simple insertion of several small pegs in matching holes provided in the various panels. The doll house has a unique roof assembly comprising two panels, which can easily be removed to expose the interior rooms.

7 Claims, 14 Drawing Figures

DOLL HOUSE HAVING LEFT AND RIGHT ROOF MEMBERS

BACKGROUND OF THE INVENTION

This invention relates to a doll house or toy house of the knock-down or collapsible type having a pleasing A-frame design and simplified construction, capable of being easily constructed or taken apart.

There have been developed various types of doll houses to provide recreation and education to children and adults. Many of these doll houses are of the permanent type presenting problems with respect to shipping and storage. Others, which are of the knock-down type are relatively complicated in construction and require various types of fasteners and locking members to hold the doll house together. These doll houses, for the most part require tools and screws for construction and lack the desired rigidity when constructed. Furthermore, more sturdy types of doll houses, which can be easily knocked-down, are desired by various adult hobbyists. These doll houses are required to have open access to the various floors in order that the hobbyists can set up various furniture arrangements, etc. Interior decorators also find the doll houses useful in planning the furniture arrangements, etc., of rooms. In particular, a doll house having an A-frame design has not been easy heretofore to construct in a knock-down type.

BRIEF SUMMARY OF THE INVENTION

Generally, the present invention provides a unique A-frame design style of a knock-down construction for a doll house. The doll house is constructed with a unique roof design and a small number of panels provided with grooves and slots so that all parts slide together easily and support one another. The entire doll house assembles easily in minutes using no tools or screws, and once assembled, all the parts are locked tightly together to provide a rigid, sturdy structure by the simple insertion of several small pegs strategically arranged with respect to the structure of the doll house. The unique roof assembly comprises two panels which easily interlock together and are easily disassembled.

It is, therefore, an object to this invention to provide a doll house having a unique A-frame design capable of being easily constructed without special skill or the use of tools and fasteners, and which can be easily disassembled or knocked-down for storage or transport purposes.

Another object of this invention is to provide a doll house that is relatively rigid and sturdy in construction when assembled, requiring only simple pegs for holding the assembled house together.

A further object of this invention is to provide a doll house constructed from novel arrangement of panels provided with grooves and slots whereby construction or disassembly of the doll house is facilitated.

Another object of this invention is to provide a novel A-frame design for a doll house whereby two roof panels are held in place on the front and rear walls and interlock with each other to form a unique roof construction.

A further object of this invention is to provide a unique roof construction for the doll house wherein one portion of the roof can be removed to expose interior rooms.

Other objects, advantages and features of the invention will become apparent from the following detailed description of a preferred embodiment of the invention when considered with the accompanying drawings.

DETAILED DESCRIPTION OF THE INVENTION

Figure 1:
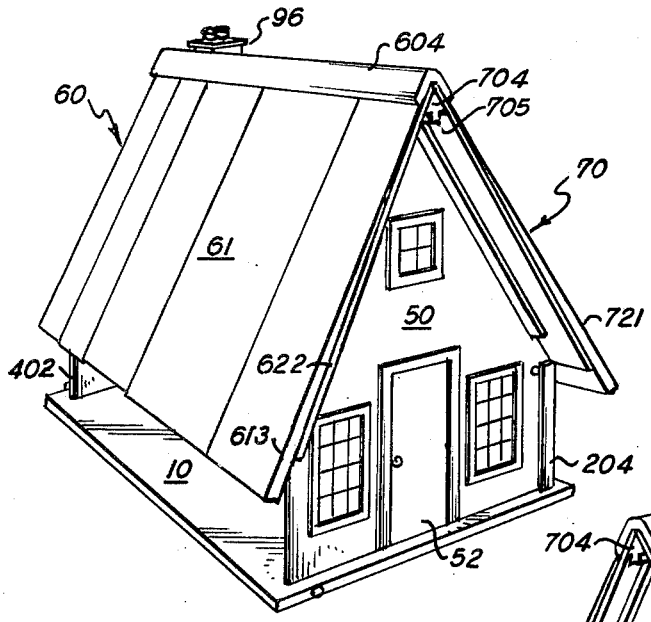
FIG. 1 is a perspective view of the left front of the doll house as fully assembled embodying the novel aspects of the invention.
Figure 2:
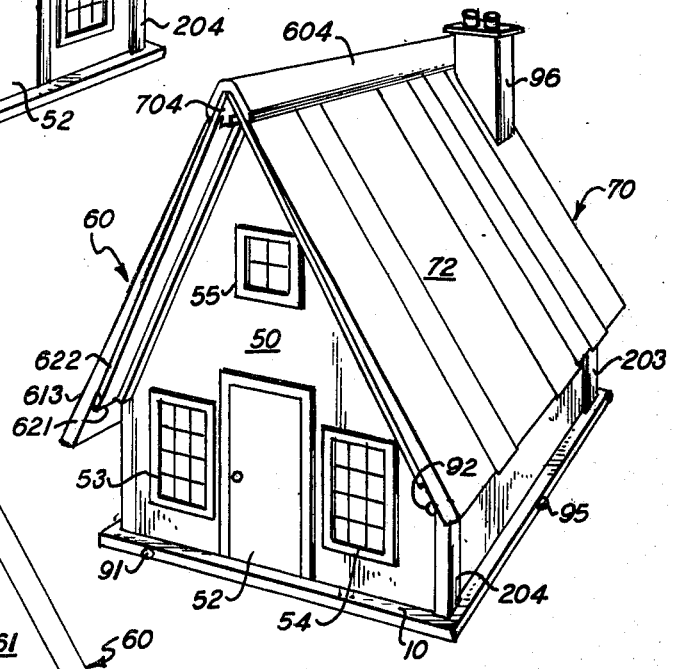
FIG. 2 is a perspective view of the right front of the doll house fully assembled.
Figure 3:
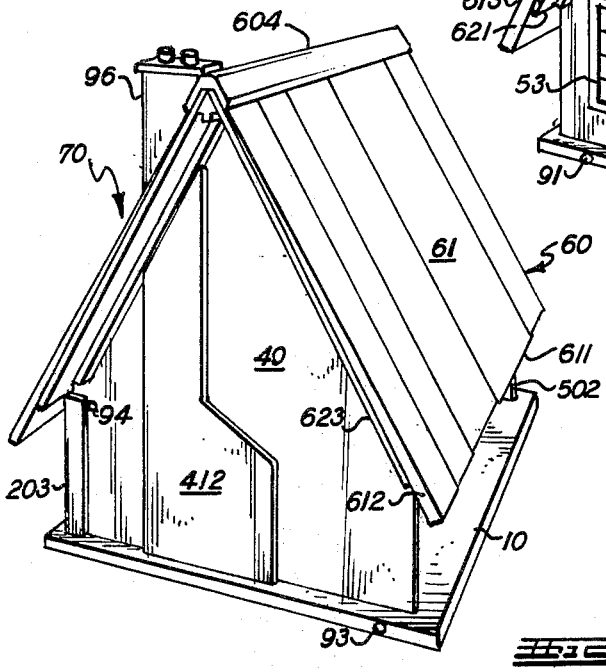
FIG. 3 is a perspective view of the rear of the house fully assembled.
Figure 4:
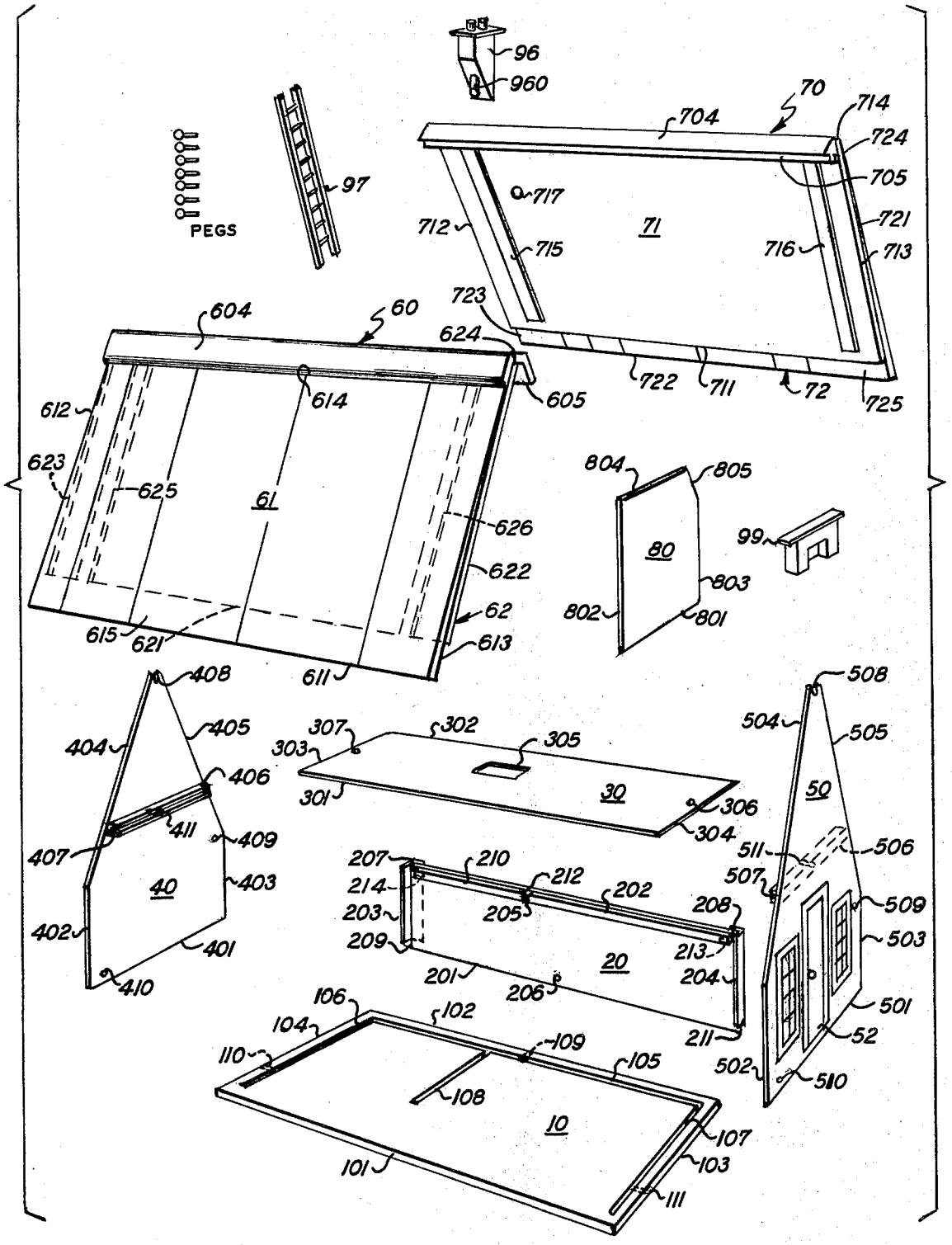
FIG. 4 is an exploded perspective view of the doll house as seen from the left as in FIG. 1 disclosing front, rear and right walls as well as the floors, roof, and various parts of the doll house.

Referring to the drawings, FIGS. 1 and 2 show perspective front views of a doll house embodying the principles of the invention and FIG. 3 shows a perspective rear view of the doll house. These views show the doll house fully assembled and ready for use as a recreational device or as a model house for display purposes with furniture arrangements, etc. FIG. 4 is an exploded perspective view of the doll house from the left side disclosing the various parts and the manner in which they are assembled together.

The doll house comprises a rectangular base or first floor member 10 having grooves 105, 106, 107 and 108 in the top surface, front edge 103, right edge 102, left edge 101, and rear edge 104. A right side wall member 20 comprises bottom edge 201, front edge 211, rear edge 209, top edge 212 with horizontal beam members 210 and 202 disposed therealong and slots 207, 205 and 208. Edge 209 contains integral L-shaped beam 203 and edge 211 contains integral L-shaped beam 204.

The rear wall 40 comprises slanted edges 404 and 405 with a slot 408 at the top, bottom edge 401, left edge 402, right edge 403, and horizontal beam member 406 with groove 407.

Similarly, a front wall member comprises slanted edges 504 and 505 with slot 508 at the top, bottom edge 501, left edged 502, right edge 503 and horizontal beam member 506, with groove 507. A door 52 and windows such as 53, 54 and 55 are also disposed in the front wall.

An intermediate wall member 80 comprises right edge 803, left edge 802, bottom edge 801, top edge 804, and slant edge 805.

A second floor member 30 comprises front edge 304, rear edge 303, left and right side edges 301 and 302, and stair well 305.

A left roof member 60 comprises an inner panel 62 and an outer panel 61. Panel 62 comprises edges 621, 622, 623, 624 and inner longitudinal beams 625 and 626. Panel 61 is a composite of longitudinal shingles 615 forming the panel with edges 611, 612, 613, and 614. A horizontal beam 604, having an angular cross-section, is secured to the upper edge 624 of panel 62. A right roof member 70 comprises an inner panel 71 and an outer panel 72. Panel 71 comprises edges 711, 712, 713 and 714 and inner longitudinal beams 715 and 716. Panel 72 is a composite of longitudinal shingles 725 forming the panel with edges 721, 722, 723 and 724. A horizontal ridge beam 704, having a triangular cross-section with a downwardly depending rib portion 705, is secured to the inner part of edge 714. A chimney 96 comprising peg 960 is adapted to be inserted in hole 717 of roof member 70 and disposed to align in profile with the simulated chimney 412 on rear wall 40.

Figure 12:
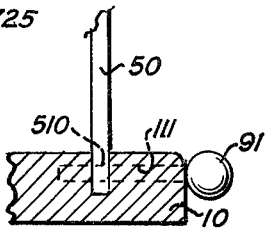
FIG. 12 is an enlarged, fragmentary, side partial sectional view of the assembled front wall and first floor disclosing details of how they are held together by a peg.
Figure 6:
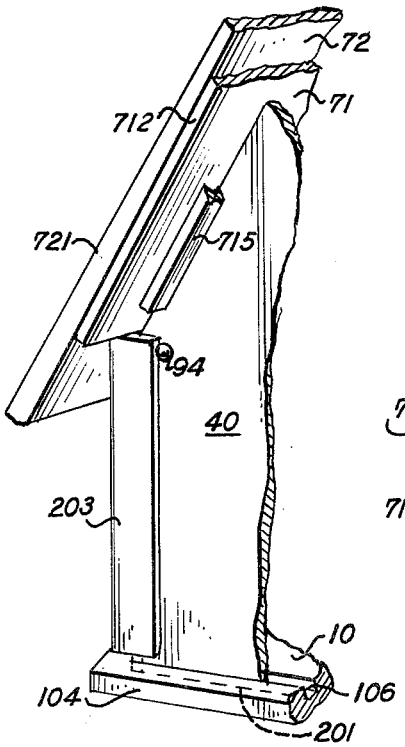
FIG. 6 is an enlarged, perspective, fragmentary view of the left rear corner of the doll house disclosing construction details thereof.

The various members of the doll house are adapted to be assembled together and held together with pegs. The bottom edge 201 of side wall 20 is inserted in groove 105 of the first floor 10, and rear wall 40 and front wall 50 are inserted in grooves 106 and 107 respectively. The front edges 403 and 503 of walls 40 and 50 each fit within left corner beam member 203 and slot 207 and right corner beam member 204 and slot 208 of side wall 20, respectively. The three walls are retained in place by inserting peg 93 in holes 410 and 110 of wall 40 and floor 10 and similarly, peg 91 in holes 510 and 111 of wall 50 and floor 10 (see FIG. 12); peg 95 in hole 109 in the groove 105 of floor 10 and hole 206 of wall 20; peg 92 in front wall hole 509 and hole 213 in end of beam 202; and peg 94 in rear wall hole 409 and hole 214 in end of beam 210.

Figure 13:
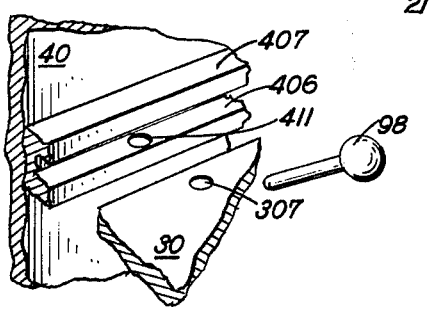
FIG. 13 is an enlarged framentary perspective view of the rear wall and second floor disclosing details of the assembly thereof.
Figure 9:
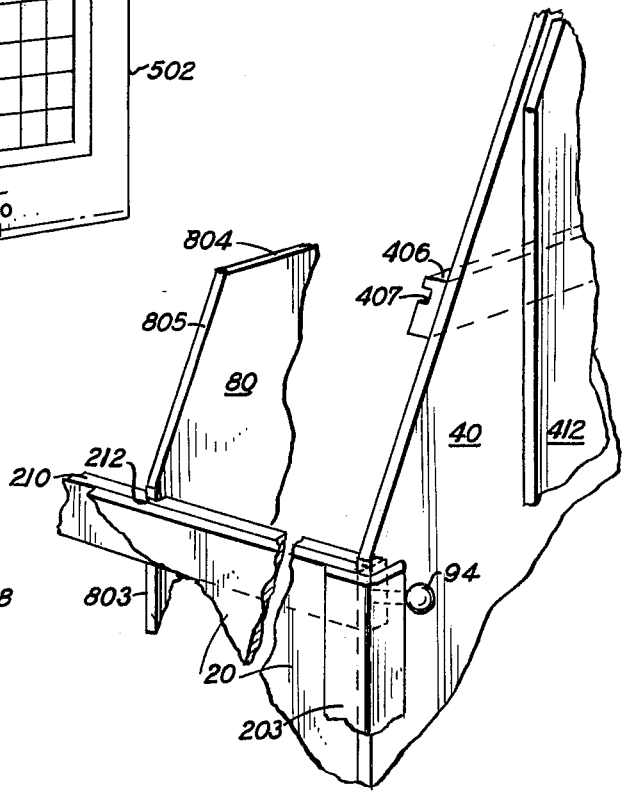
FIG. 9 is an enlarged, perspective, fragmentary view from the rear with both panels of the roof removed, of the left rear corner disclosing details of assembly of the left side wall, rear wall, and intermediate wall.
Figure 14:
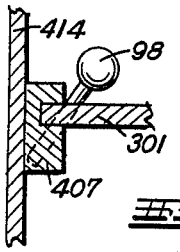
FIG. 14 is an enlarged fragmentary, cross-sectional view of the assembled rear wall and second floor shown in FIG. 13 disclosing details of how they are held together by a peg.

Intermediate wall 80 is next inserted in groove 108 of floor 10, and also the front edge 803 is inserted in slot 205 of side wall 20. Second or loft floor 30 is next assembled by sliding rear and front edges 303 and 304 simultaneously in grooves 497 and 507 of the rear and front walls 40 and 50, respectively. The loft floor is pushed forward until its left and right side edges 301 and 302 are within the slanted edges of the front and rear walls. The loft floor is retained in place by inserting peg 98 in hole 307 of the second floor and hole 411 in beam 407 of the rear wall (see FIGS. 13 and 14), and, similarly another peg (not shown) is inserted in hole 306 of the second floor and hole 511 in beam 506 of the front side wall.

Figure 8:
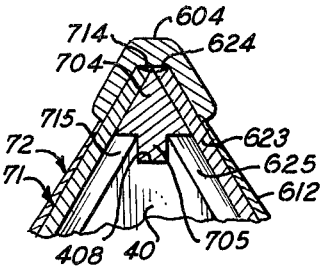
FIG. 8 is partial, cross-sectional view of the horizontal beam and ridge beam of the novel roof construction.
Figure 7:
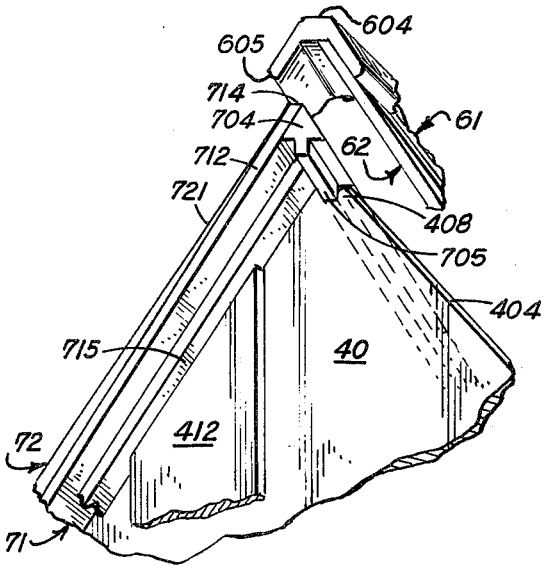
FIG. 7 is an enlarged, perspective, fragmentary view of a rear portion of the doll house disclosing details of the novel construction and assembly of the roof.

The right roof member 70 is first installed by inserting the rib portion 705 of the beam 704 in slots 408 and 508 of the rear and front walls, respectively. The inner surface of the roof panel 71 rests on the slanted edges 405 and 505 of the rear and front walls, respectively. Edges 405 and 505 are disposed adjacent and between beams 715 and 716, respectively. The lower edge 711 of panel 71 rests on edge 212 of the right side wall 20. Shingles 725 extend downwardly beyond the left side wall. The left roof member 60 is installed with beam 604 overlapping beam 704 of roof member 70 whereby the two beams interlock as shown in FIGS. 7 and 8. The inner surface of roof panel 62 rests on the slanted edges 404 and 504 of the rear and front walls, respectively. Edges 404 and 504 are disposed adjacent and between beams 625 and 626, respectively. The lower edge 621 extends across the juncture of edges 404 and 402 of wall 40 and the juncture of edges 504 and 502. The shingles 615 extend downwardly beyond the junctures a short distance across the opening on the left side of the doll house (see FIG. 1). The chimney 96 is installed on roof 70 by inserting peg 960 of the bottom slanted surface in hole 717 of the roof 70.

The placement of the pegs for holding the doll house together is uniquely designed for easy assembly as well as providing the rigidity required for the doll house. For the most part, a triangular arrangement is provided for the pegs. Thus, e.g., pegs 93, 95 and 98; 91, 95 and 94, etc., form triangular non-colinear constructions which rigidly retain the walls to each other and to the floors.

Figure 5:
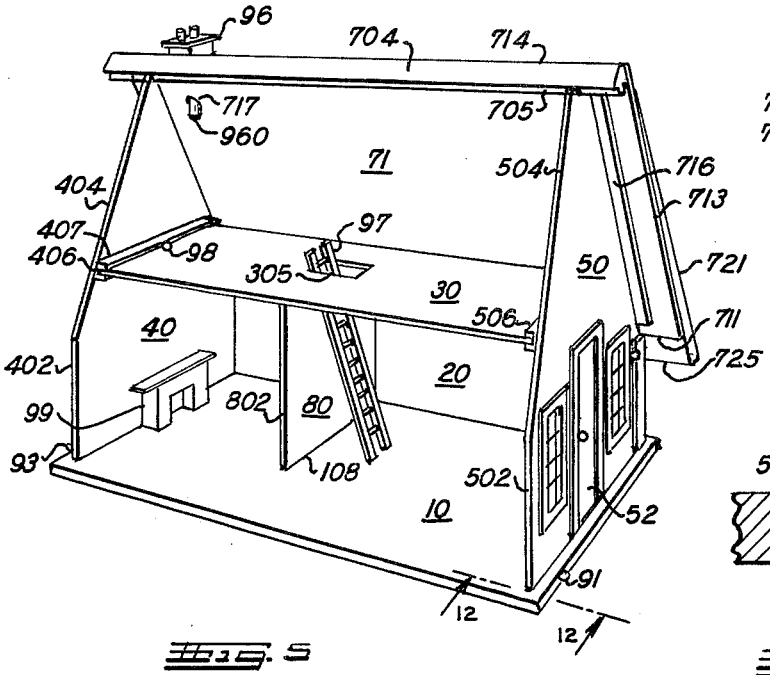
FIG. 5 is a perspective view of the left side of the doll house with one roof panel removed disclosing details of the interior of the doll house.

As shown in FIG. 5, a ladder can be installed between the first floor and second or loft floor. The bottom 620 of the ladder rests on the first floor 10 and the upper portion extends through the stair well 305 and rests on a ledge thereof.

A decorative unitary fireplace 99 is placed against the inner rear wall 40 on the first floor. The fireplace aligns with the simulated chimney 412 on the outer wall of side wall 40 and chimney 96 on the roof (see FIGS. 3 and 5).

Figure 10:
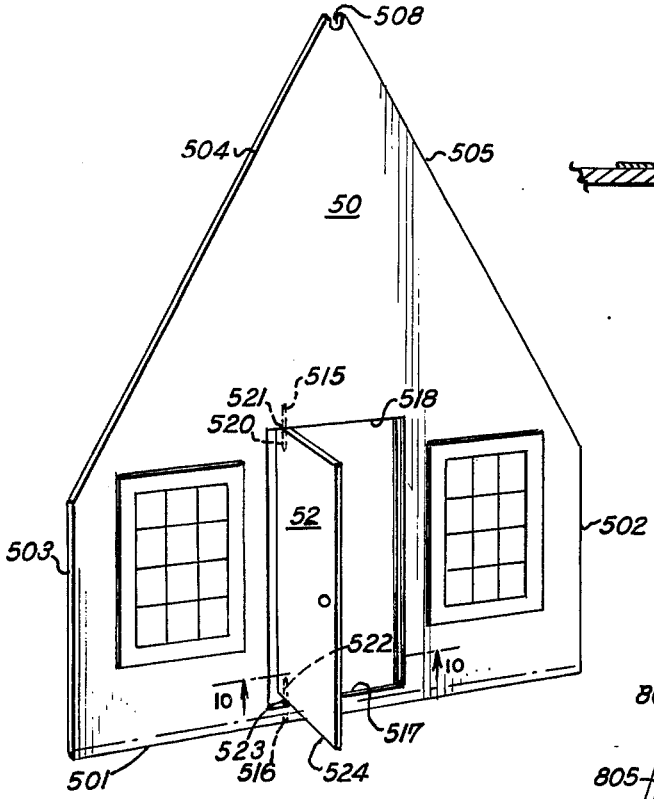
FIG. 10 is an inside perspective view of the front wall of the doll house disclosing details of the door assembled therein.
Figure 11:
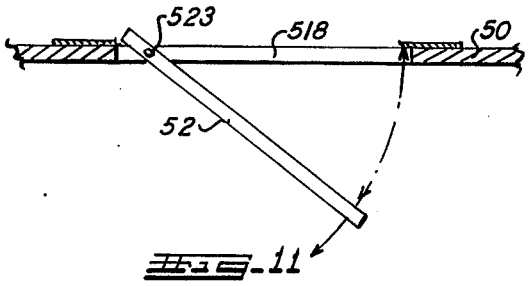
FIG. 11 is a view taken along line 10–10 of FIG. 10.

In FIG. 10, a novel means for installing a door 52 in a doorway 518 on the first floor of the front wall 50 is provided. The door 52 has an upwardly extending pin 512 initially inserted in hole 520. The door is angled into the top of the doorway and the end of pin 521 marks a point on the underside of the top of the doorway where a hole 515 is drilled after the door is removed. Pin 521, is removed from hole 520 and is inserted in hole 515. The door 52 is then fitted into the doorway 518 with the door and hole 520 angled into the exposed pin 521 until the door is mounted flush in the doorway. Two holes 516 in wall 50 and 522 in door 52 are drilled simultaneously up through the bottom edge 501 of wall 50 and bottom edge 524 of the door. Pin 523 is inserted first in hole 516 and then hole 522 to secure the door in the doorway. This procedure assures alignment of the holes and flushness of the door in the doorway.

The doll house is knocked-down or disassembled by reversing the above procedure. The unique and novel design provides the benefits of knock-down construction. The use of grooves and slots provide means for easily sliding the various parts together, which support one another. The doll house is rigid in construction and all parts are held together tightly by the simple insertion of a relatively small member of strategically arranged small pegs. When disassembled, the parts of the doll house can be stacked together for easy storage or shipment.

Although the doll house of this invention has been disclosed heretofore as the preferred embodiment, wherein two rooms and a loft are available by using the one intermediate wall member 80, it is understood that the doll house can be constructed to contain more than one intermediate wall member thus providing three or more rooms on the first floor. It is also contemplated within the concept of the invention that intermediate wall member 80 can extend through the second floor to provide the loft of the doll house with additional rooms.

The doll house, as assembled, is a rigid structure presenting an overall pleasing appearance with the A-frame design. The exposure of the internal rooms in simple and merely requires lifting roof member 60 away from the construction.

The above description of the invention is deemed to be the most practical and efficient embodiment and it should be understood that the invention is not limited to such embodiments as heretofore indicated as there could be further changes made in the arrangement, disposition and form of the parts without departing from the principle of the present invention within the scope of the accompanying claims.

What is claimed is:

1. An easily assembled knock-down doll house having an A-frame design, the parts of which are fitted together and held together only with pegs comprising:

a. a generally rectangular first floor member comprising right, rear, and front grooves in the top surface thereof, at least one intermediate groove in said surface parallel to said rear and front grooves;

b. a right side wall member having a size and shape adapting it to have its bottom edge engage said right groove of said first floor member, comprising vertical L-shaped beams at its opposite ends and a top horizontal beam member disposed on the inner front wall containing at least one vertical slot;

c. rear and front wall members having respective sizes and shapes adapting them to have their right edges engage respective said L-shaped beams of said right side wall member and their bottom edges engage c. respective said rear and front grooves of said first floor, each of said walls containing an inner horizontal beam member having an inward said groove, each of said walls containing inwardly slanted upper right and left edges, and a slot disposed at the terminus of said angled top edges;

d. at least one intermediate wall member comprising a right inwardly slanted edge and having a size and shape adapting it to have its lower edge engage a respective said intermediate groove in said first floor and a said vertical slot of said right wall top beam member;

e. a second floor member comprising a stairwell, and having a size and shape adapting it to have its rear and front edges engage said grooves of said beam members of said rear and front walls;

f. a left roof member comprising an angled horizontal beam member secured to the top edge of said roof member;

g. a right roof member comprising a horizontal ridge beam member comprising downwardly depending rib means, said ridge beam secured to the inner top edge of said roof member;

h. said right roof member having a size and shape adapting it to have said rib means engage said terminus slots of said rear and front wall members, and to have said inner surface of said right roof member engage said inwardly slanted edge of said intermediate member and said right edges of said rear and front wall members, said left roof member being constructed and arranged to have said angled horizontal beam member engage and overlap said horizontal ridge beam member, and to have said inner surface of said right roof member engage said inwardly slanted left edges of said rear and front wall members;

i. a plurality of pegs having respective sizes and shapes adapting them to be inserted in holes contained in said walls and floor members at their junctures with each for retaining said assembled structure together.

2. The doll house of claim 1 wherein each of said left and right roof members comprise front and rear longitudinal beam members disposed on the underneath side and adjacent the front and rear edges of said roof members, and wherein said longitudinal beam members have respective sizes and shapes adapting them to be disposed and engage the outer surface of said slanted edges of said rear and front wall members.

3. The doll house of claim 1 wherein said roof members comprise an inner panel and an outer panel, said outer panel comprising vertical longitudinal shingles.

4. The doll house of claim 1 wherein said ridge beam member of said right roof member has a triangular cross-section with a downwardly depending rib portion.

5. The doll house of claim 1 wherein said rear wall member has a simulated chimney on its outer surface adapted to be in line with a chimney member having a size and shape adapting it to be engaged in the top rear surface of one of said roof members, and a simulated fireplace disposed on said first floor along said inner rear wall.

6. The doll house of claim 1 wherein a ladder has a size and shape adapting it to be installed within and between said stairwell of said second floor and said first floor.

7. The doll house of claim 1 wherein said front wall contains a door installed within a doorway, said door comprising a first disposed in a hole in its upper edge, said first pin also engaging a predrilled hole in an upper edge of said doorway, a second pin disposed through simultaneously drilled holes through a lower edge of said doorway and the lower edge of said door, whereby said door has a size and shape adapting it to be mounted flush in said doorway and capable of bein opened or closed.

* * * * *